US010595598B2

(12) United States Patent
De Los Santos

(10) Patent No.: US 10,595,598 B2
(45) Date of Patent: Mar. 24, 2020

(54) JEWELRY SPRING RING CLASP ASSEMBLY

(71) Applicant: Clarisse Khriselle Ramos De Los Santos, San Diego, CA (US)

(72) Inventor: Clarisse Khriselle Ramos De Los Santos, San Diego, CA (US)

( * ) Notice: Subject to any disclaimer, the term of this patent is extended or adjusted under 35 U.S.C. 154(b) by 0 days.

(21) Appl. No.: 16/099,194

(22) PCT Filed: Jul. 3, 2018

(86) PCT No.: PCT/US2018/040806
§ 371 (c)(1),
(2) Date: Nov. 6, 2018

(87) PCT Pub. No.: WO2019/010235
PCT Pub. Date: Jan. 10, 2019

(65) Prior Publication Data

US 2019/0133267 A1 May 9, 2019

Related U.S. Application Data

(60) Provisional application No. 62/528,249, filed on Jul. 3, 2017.

(51) Int. Cl.
*A44C 17/02* (2006.01)
*A44C 5/20* (2006.01)
(Continued)

(52) U.S. Cl.
CPC ..... *A44C 5/2014* (2013.01); *A44C 5/00* (2013.01); *A44C 15/005* (2013.01); *A44C 17/02* (2013.01)

(58) Field of Classification Search
CPC ..... A44C 5/18; A44C 5/20; A44C 5/2009; A44C 5/2014; A44C 17/02; A44C 17/0208; A44C 17/0216
(Continued)

(56) References Cited

U.S. PATENT DOCUMENTS 367,449 A * 8/1887 Scott ..... A44C 17/0208 63/29.1
983,295 A * 2/1911 Lawson ..... A44C 17/02 63/26
(Continued)

FOREIGN PATENT DOCUMENTS

FR 760256 A 12/1933
WO 2008017396 A1 2/2008
WO D070485 5/2008

*Primary Examiner* — Emily M Morgan
(74) *Attorney, Agent, or Firm* — Lance M. Pritikin

(57) ABSTRACT

An exemplary jewelry spring ring clasp assembly includes a ring element and a setting element. The ring element extends circumferentially about a main axis to define a ring aperture therethrough. A static segment of the ring element has an inboard face and an outboard face disposed opposingly along the main axis. A door segment of the ring element is actuatable between closed and open positions. The setting element is in fixed engagement with the static segment, and is configured to retain an ornamental element in a fixed position along the main axis so that the ornamental element visually obscures the ring aperture and the ring element from a viewpoint defined outward of the outboard face. The visual obscurement may apply to at least a circumferentially-continuous portion of the ring element, and may be due in part to optical refraction through the ornamental element or optical opacity of the ornamental element.

22 Claims, 8 Drawing Sheets

(51) Int. Cl.
*A44C 5/00* (2006.01)
*A44C 15/00* (2006.01)

(58) Field of Classification Search
USPC ..... D11/206, 215, 91, 92
See application file for complete search history.

(56) References Cited

U.S. PATENT DOCUMENTS 1,386,746 A * 8/1921 Wachenheimer .... A44C 5/2014 24/598.3
1,442,096 A 1/1923 Robinson
1,556,465 A 10/1925 Wendel
2,051,591 A 8/1936 Brogan
3,144,692 A * 8/1964 Espino ..... A44B 5/002 24/97
3,950,828 A 4/1976 Szamborski
4,000,627 A 1/1977 Wahlbeck
4,055,057 A * 10/1977 Kolman ..... A44C 5/2014 63/7
4,430,778 A 2/1984 Sander
4,483,050 A * 11/1984 Nanni ..... A44C 5/2014 24/598.3
4,781,038 A 11/1988 Branca et al.
4,800,738 A 1/1989 Bunz
5,214,940 A 6/1993 Capifali
5,339,655 A * 8/1994 Grando ..... A44C 5/102 59/80
D379,074 S 5/1997 Udko
5,694,791 A * 12/1997 Esposito ..... A44C 11/007 63/3
5,722,260 A 3/1998 Mangano
7,207,091 B2 4/2007 Dunaye
7,296,438 B2 11/2007 Kolb
D622,173 S 8/2010 Blad et al.
D651,935 S 1/2012 Greer
D834,444 S * 11/2018 Dousset ..... D11/91
2002/0026808 A1* 3/2002 Chia ..... A44C 11/007 63/26
2009/0013721 A1 1/2009 Murao
2015/0040358 A1 2/2015 Burns

* cited by examiner

JEWELRY SPRING RING CLASP ASSEMBLY

RELATED APPLICATIONS

This application is a U.S. national stage of PCT International Patent Application No. PCT/US2018/040806 having an international filing date of Jul. 3, 2018, which claims the benefit of U.S. Provisional Application No. 62/528,249 filed Jul. 3, 2017. All of the above-identified applications are hereby incorporated by reference in their entireties as though fully and completely set forth herein.

TECHNICAL FIELD

The disclosure herein relates generally to items of jewelry such as necklaces. More particularly, disclosed herein are devices and methods for improving the visual aesthetics of a jewelry spring ring clasp mechanism.

BACKGROUND

The conventional art of jewelry clasps is often an unattractive afterthought and can be difficult to put on. Oftentimes, the fastener will move to a position not intended by the wearer. For example, a necklace pendant will frequently shift to the wearer's back and the clasp will move to the wearer's front. Furthermore, when the wearer must put on the jewelry piece themselves, conventionally the easiest way to do so is by fastening the clasp in the front then shifting it around to the back. What is needed is an improved jewelry clasp that not only can be used as the visual focal point of the jewelry but can also eliminate the need for a separate fastener altogether.

SUMMARY

Examples of a jewelry spring ring clasp assembly in accordance with the present disclosure address one or more of the deficiencies of the prior art, and may include at least a ring element and a setting element. The ring element may extend circumferentially about a main axis so as to define a ring aperture through the ring element. The ring element may have a static segment and a door segment. The static segment may have an inboard face and an outboard face disposed oppositely of one another along the main axis. The static segment may preferably be arcuately discontinuous so as to define a link insertion gap disposed radially of the main axis. The door segment is generally actuatable between a closed position and an open position. The link insertion gap is latchedly blocked when the door segment is in the closed position. The link insertion gap is traversable in a radial direction with respect to the main axis when the door segment is in the open position. The door segment may be spring-biased toward the closed position.

The setting element is preferably in fixed engagement with the static segment, and configured to retain an ornamental element in a fixed position along the main axis so that the ornamental element visually obscures the ring aperture and the ring element from a viewpoint defined along the main axis outward of the outboard face. Depending upon the particular embodiment of the assembly, the visual obscurement may apply to at least a circumferentially continuous portion of the ring element, and may be due at least in part to optical refraction through the ornamental element or optical opacity of the ornamental element.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
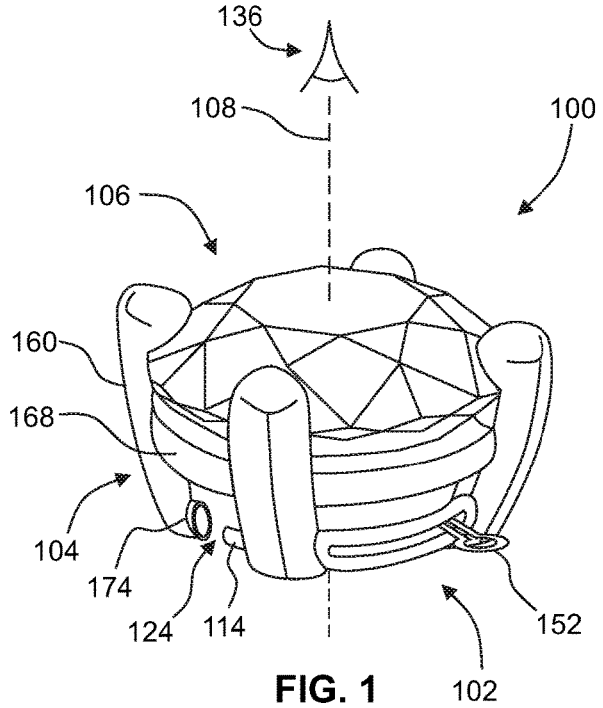
FIG. 1 is a diagrammatic perspective view of one example jewelry spring ring clasp assembly in accordance with the present disclosure, wherein the setting element includes a multiplicity of prong members distributed about the ring element and extending outward of the outboard face so as to provide a basket setting.

Referring now to the drawings, like reference numerals designate identical or corresponding features throughout the several views.

Figure 3:
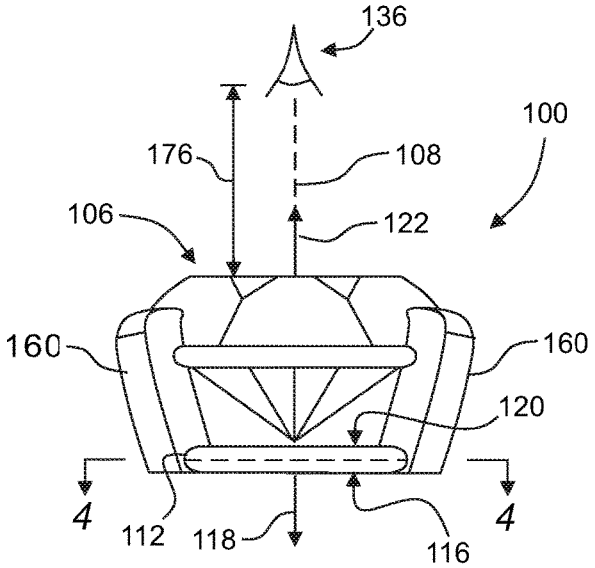
FIG. 3 is a diagrammatic side view of the jewelry spring ring clasp assembly of FIG. 1, further illustrating a viewpoint defined along the main axis outward of the outboard face.

With reference to the several drawings, embodiments of a jewelry spring ring clasp assembly are shown generally at 100, and may preferably comprise at least a ring element 102 and a setting element 104. The ring element 102 may preferably extend circumferentially about a main axis 108 and thereby define a ring aperture 110 through the ring element 102. The ring element 102 may have a static segment 112 and a door segment 114. Referring to FIG. 3, the static segment 112 may have an inboard face 116 and an outboard face 120 disposed oppositely of one another along the main axis 108. An inboard direction 118 and an outboard direction 120 may be defined along the main axis 108. The static segment 112 may be arcuately discontinuous so as to define a link insertion gap 124 disposed radially of the main axis 108. The door segment 114 may be actuatable between a closed position (see, e.g., FIG. 6) and an open position (see, e.g., FIG. 5).

Figure 5:
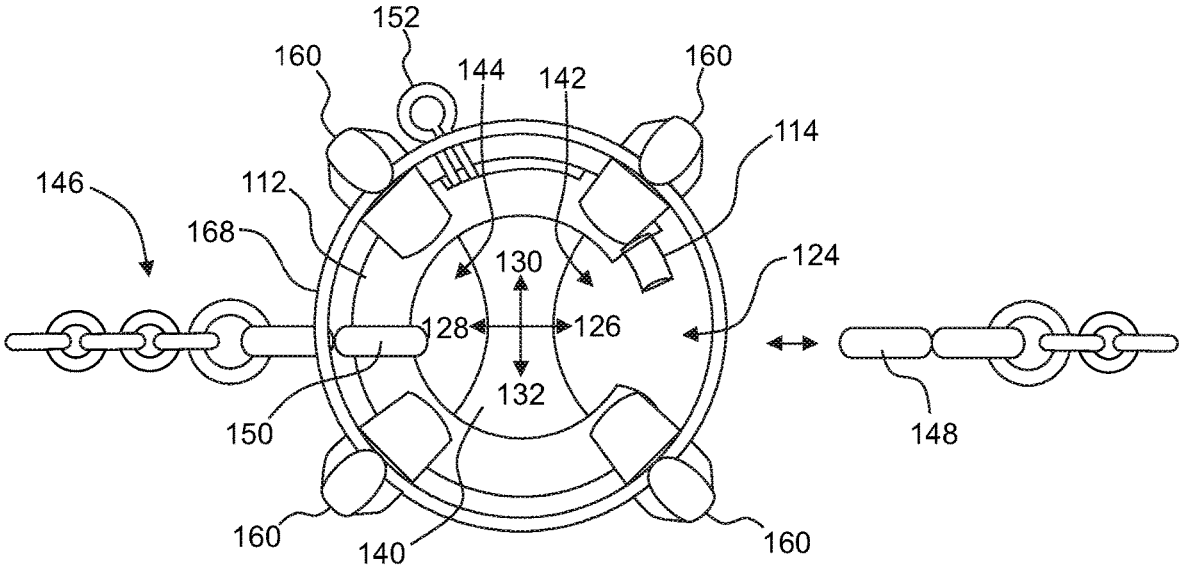
FIG. 5 is a diagrammatic front view of the jewelry spring ring clasp assembly of FIG. 1 without the ornamental element, thereby showing the door segment in its open position and the first end link out of engagement with the spring ring.
Figure 6:
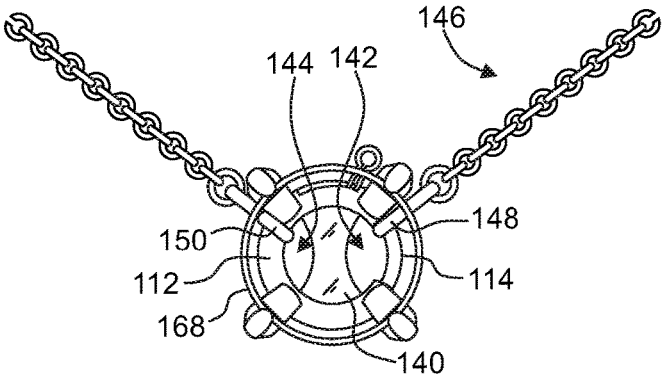
FIG. 6 is a diagrammatic front view of the jewelry spring ring clasp assembly similar to that of FIG. 5, but shown in a hanging configuration with the first end link secured in engagement with the spring ring by way of the door segment being in its closed position.
Figure 11:
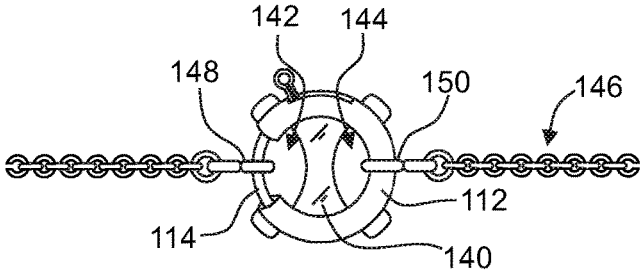
FIG. 11 is a diagrammatic rear view of the jewelry spring ring clasp assembly similar to that of FIG. 10, but showing the jewelry chain in a non-hanging configuration.

Referring to FIGS. 6 and 11, when the door segment 114 is in the closed position, the link insertion gap 124 is preferably latchedly blocked. Such lateral blockage may be sufficient to, for example, prevent a first end link 148 from traversing (e.g., entering or exiting) the link insertion gap 124 in a radial direction with respect to the main axis 108. Contrastingly, referring to FIGS. 1 and 5, the link insertion gap 124 is preferably traversable (e.g., by the first end link 148) in a radial direction with respect to the main axis 108 when the door segment 114 is in an open position. With regard to preferred embodiments of the jewelry spring ring clasp assembly 100, FIG. 5 illustrates a first radial direction 126, second radial direction (opposite the first radial direction), a third radial direction 130 (orthogonal to first and second radial directions) and a fourth radial direction 132 (opposite the third radial direction).

Figure 4:
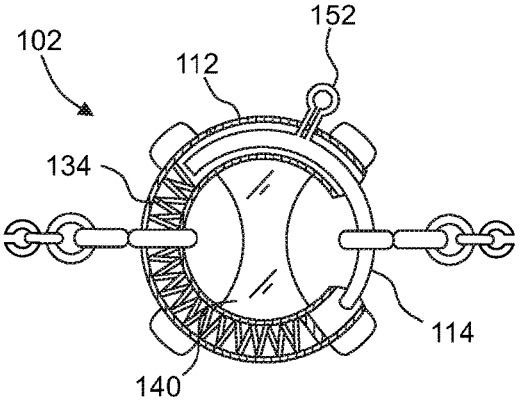
FIG. 4 is a diagrammatic cross-sectional view taken along lines 4-4 of FIG. 3.

Referring to FIG. 4, the static segment 112 may comprise a hollow tube, at least a portion of the door segment 114 being slidably received within the hollow tube. In preferred embodiments of the assembly 100, the door segment 114 may be spring-biased toward the closed position. Such spring bias may be provided by a spring element 134, similarly to a corresponding mechanism used in conventional spring ring clasps.

Referring to FIGS. 4-6, in preferred embodiments of the jewelry spring ring clasp assembly 100, the door segment 114 is of the type retractable into a hollow cavity of the static segment 112 and configured to move between its open and closed positions along a circumference defined by the shape of the static segment 112. Referring to FIG. 8A, in particular alternate embodiments of the jewelry spring ring clasp assembly, it is envisioned that the door segment 114*a* may be of a type wherein a first end of the door segment is hingedly affixed to the static element 112*a* at a door pivot axis 182 located at a first side of the link insertion gap. In such an alternate embodiment, the door segment 114*a* may be actuated about the door pivot axis 182 between its closed position and its open position, thus moving a second end of the door segment along an arcuate pathway in a direction generally radially outwardly from and inwardly toward the main axis 108.

Figure 2:
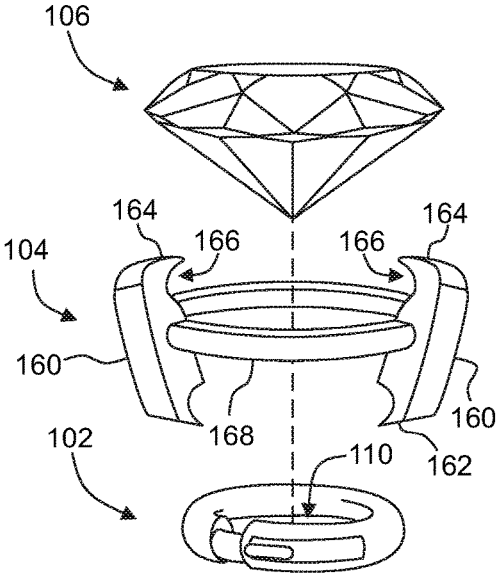
FIG. 2 is a diagrammatic exploded or disassembled view of the jewelry spring ring clasp assembly shown in FIG. 1.
Figure 7:
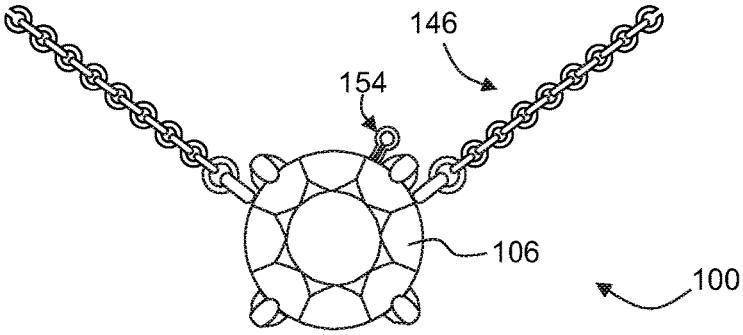
FIG. 7 is a diagrammatic front view of the jewelry spring ring clasp assembly similar to that of FIG. 6, but showing the ornamental element retained by the setting element in a fixed position along the main axis so that the ornamental element visually obscures the ring aperture and the ring element.
Figure 9:
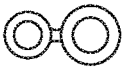
FIG. 9 is a diagrammatic plan view of an example of an end link.
Figure 10:
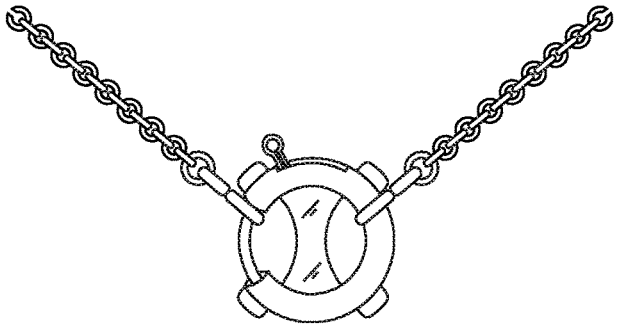
FIG. 10 is a diagrammatic rear view of the jewelry spring ring clasp assembly shown in FIG. 7.
Figure 19:
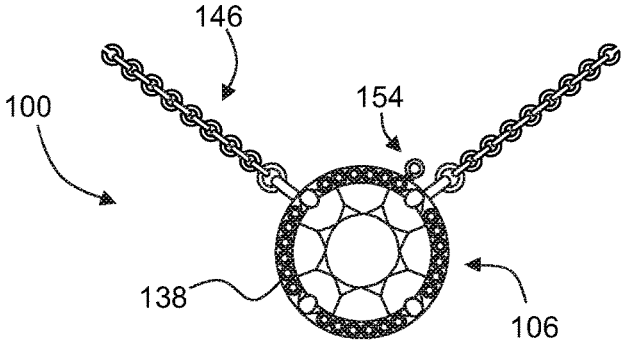
FIG. 19 is a diagrammatic front view of an alternative example of a jewelry spring ring clasp assembly, wherein the ornamental element includes a halo laterally surrounding a center gemstone.
Figure 20:
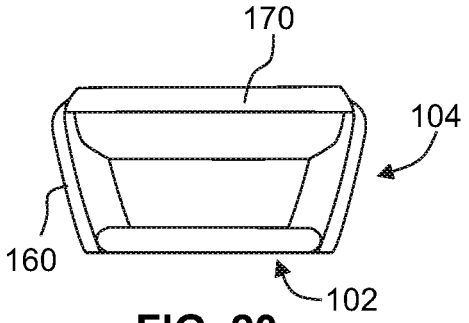
FIG. 20 is a diagrammatic side view of a further alternative example of a jewelry spring ring clasp assembly without the ornamental element, wherein the setting element includes a bezel segment and forms a bezel setting.
Figure 21:
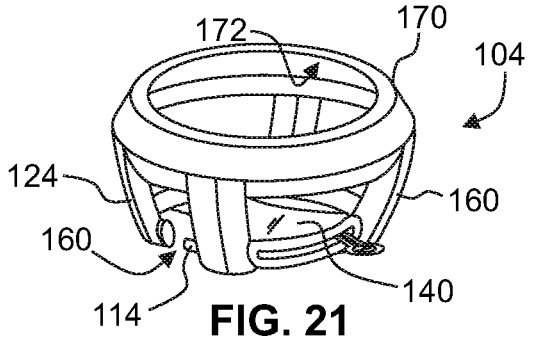
FIG. 21 is a diagrammatic perspective view of the jewelry spring ring clasp assembly of FIG. 20, showing the door segment in an open position.
Figure 22:
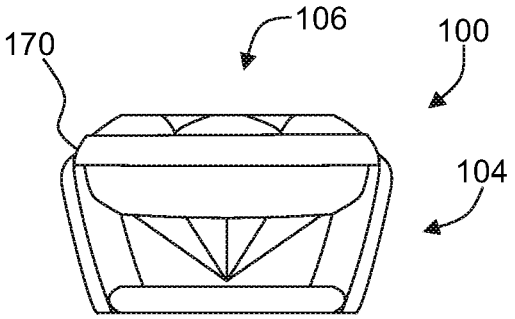
FIG. 22 is a diagrammatic side view of a jewelry spring ring clasp assembly with ornamental element, wherein the setting element includes a bezel segment.
Figure 23:
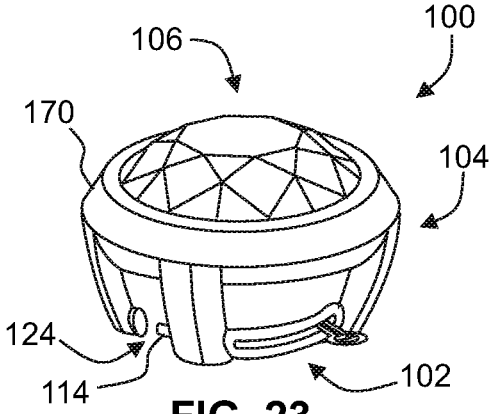
FIG. 23 is a diagrammatic perspective view of the jewelry spring ring clasp assembly of FIG. 22, showing the door segment in an open position.
Figure 24:
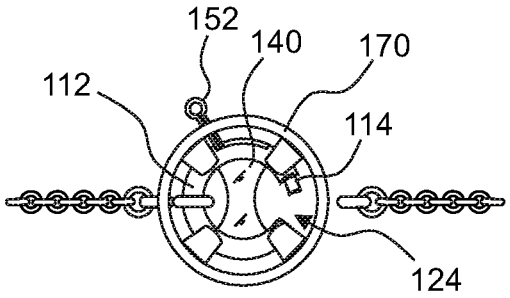
FIG. 24 is a diagrammatic front view of the jewelry spring ring clasp assembly of FIG. 21, but shown with a jewelry chain element.
Figure 25:
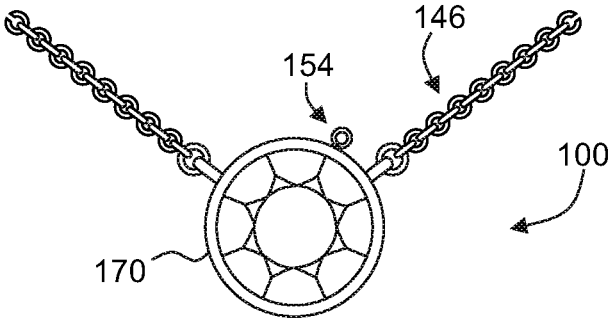
FIG. 25 is a diagrammatic front view of the jewelry spring ring clasp assembly similar to that of FIG. 23, but shown in a hanging configuration with a jewelry chain element, and with the door segment in its closed position and the radially outer portion of the trigger being visually unobscured.
Figure 26:
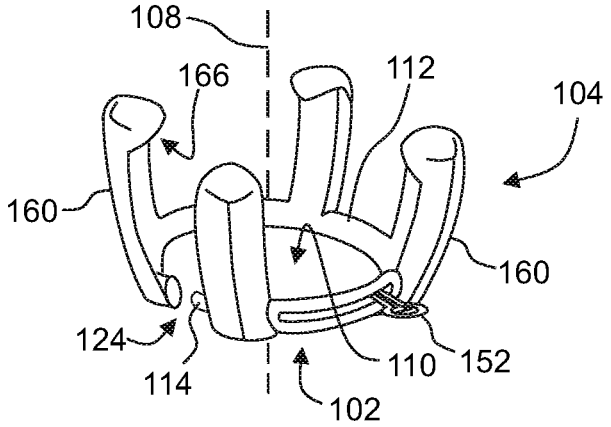
FIG. 26 is a diagrammatic perspective view of a further alternative example partially-assembled jewelry spring ring clasp assembly, wherein the setting element does not include a medial support hoop.
Figure 27:
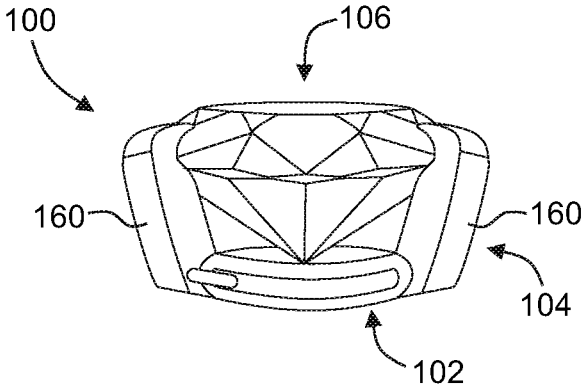
FIG. 27 is a diagrammatic perspective view of a jewelry spring ring clasp assembly similar to that of FIG. 26, but shown with an ornament element retained by the setting element.
Figure 28:
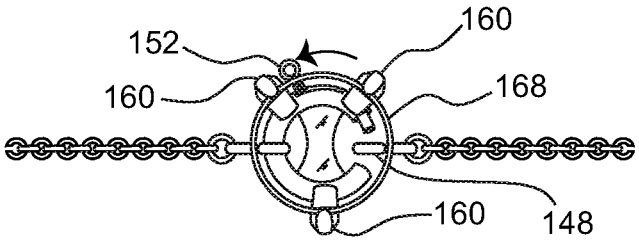
FIG. 28 is a diagrammatic front view of an alternative jewelry spring ring clasp assembly wherein the setting element includes three prong members distributed about the ring element, and shown without the ornamental element so as to reveal the door segment being maintained in its open position.
Figure 29:
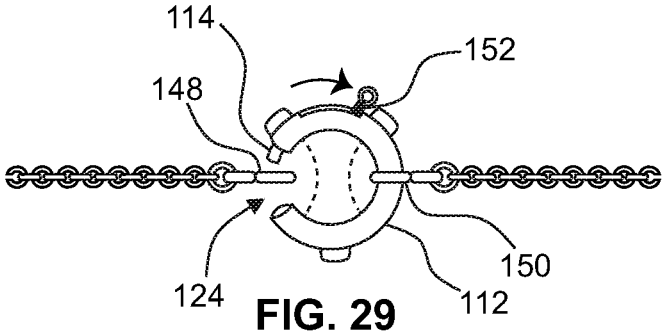
FIG. 29 is a diagrammatic rear view of a jewelry spring ring clasp assembly configured similarly to that of FIG. 28, but without a medial support hoop.
Figure 30:
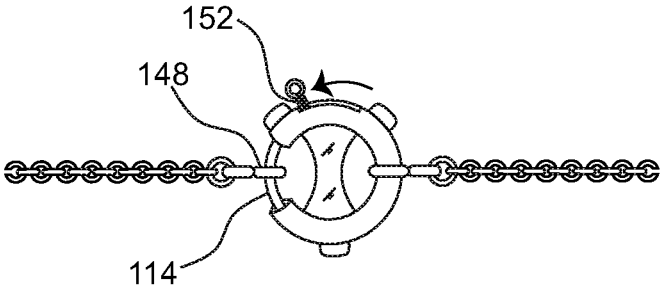
FIG. 30 is a diagrammatic rear view of the jewelry spring ring clasp assembly similar to that of FIG. 29, the first end link secured in engagement with the spring ring by way of the door segment being in its closed position.
Figure 31:
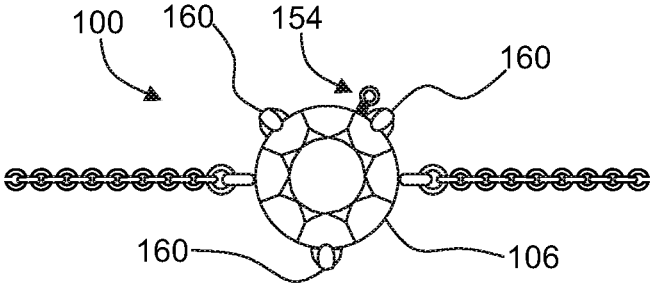
FIG. 31 is a diagrammatic front view of the jewelry spring ring clasp assembly similar to that of FIG. 30, but showing the ornamental element retained by the setting element in a fixed position along the main axis so that the ornamental element visually obscures the ring aperture and the ring element.
Figure 32:
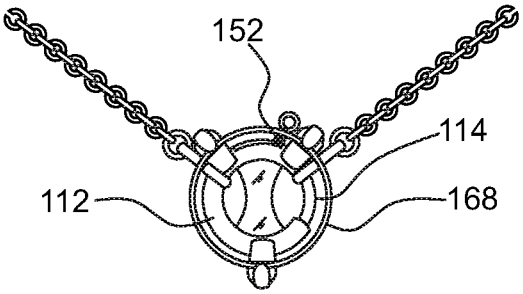
FIG. 32 is a diagrammatic front view of the jewelry spring ring clasp assembly configured similarly to that of FIG. 30, but shown in a hanging configuration and having a medial support hoop.
Figure 33:
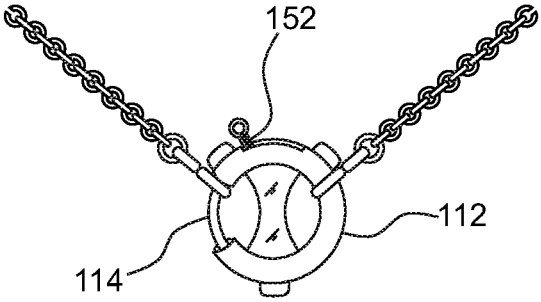
FIG. 33 is a diagrammatic rear view of the jewelry spring ring clasp assembly configured similarly to that of FIG. 30, but shown in a hanging configuration.
Figure 34:
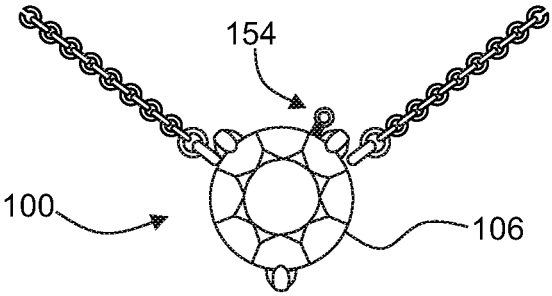
FIG. 34 is a diagrammatic front view of the jewelry spring ring clasp assembly similar to that of FIG. 33, but showing the ornamental element retained by the setting element in a fixed position along the main axis so that the ornamental element visually obscures the ring aperture and the ring element.

Referring to FIGS. 2 and 3, the setting element 104 may be in fixed engagement with the static segment 112, and configured to retain an ornamental element 106 in a fixed position along the main axis 108. This fixed engagement may be by way of, for example, soldering (see, e.g., solder joint 174 in FIG. 1) or unitary casting of the static segment 112 with the setting element 104. As a result, referring to FIG. 3, the ornamental element 106 may visually obscure the ring aperture 110 and the ring element 102 from a viewpoint 136 defined along the main axis 108 outward of the outboard face 120. For definitional reference purposes, the viewpoint 136 may be located at a distance 176 ranging, for example, from six centimeters to two meters from the jewelry spring ring clasp assembly 100. FIGS. 7, 19 and 25 illustrate the appearance of various possible embodiments of the assembly 100 from the viewpoint 136, showing how the ornamental element 106 may visually obscure the ring aperture 110 and the ring element 102 from a viewpoint 136.

Embodiments of the jewelry spring ring clasp assembly 100 may further comprise an ornamental element 106 retained in an aforementioned fixed position. In such case, as shown for example in several of the figures herein, the ornamental element 106 may include a center gemstone. The center gemstone may be facetted or have some other surface treatment. Moreover, the center gemstone may have various overall shapes or cuts, such as round, oval, cushion, princess, emerald, marquise, heart, trilliant, asscher, polygonal, baguette, radiant or pear. Moreover, such a gemstone may be, for example, transparent, translucent, opaque, or some combination thereof. Additionally, the gemstone may be made of a variety of materials, such as diamond, emerald, ruby, onyx, topaz, opal, sapphire, amethyst, aquamarine, pearl, peridot, zircon, jade or the like.

Referring to FIGS. 15-19, in certain embodiments of the jewelry spring ring clasp assembly 100, the ornamental element 106 may include a halo 138 laterally (e.g., circumferentially) surrounding the center gemstone.

Figure 8:
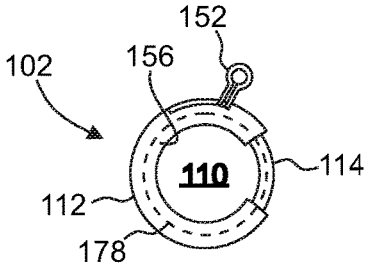
FIG. 8 is a diagrammatic front view of a ring element, illustrating one non-limiting example of a circumferentially continuous portion of the ring element defined as the portion radially inward of the dashed line.
Figure 8A:
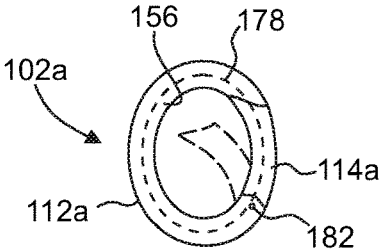
FIG. 8A is a diagrammatic front view of an alternative ring element having an alternate shape and an alternate door segment actuation configuration, wherein the door segment is shown hingedely actuated between its closed and open positions.

Referring to FIGS. 4-6, particular embodiments of a jewelry spring ring clasp assembly 100, may further comprise a back plate 140 extending, for example, diametrically, across the ring aperture 110 (see FIG. 8). Referring to FIG. 3, the back plate 140 may be affixed, for example, to the inboard face 116 of the ring element 102, the outboard face 120 of the ring element 102, a position therebetween, or from one prong element 160 to an opposingly-disposed prong element 160. Referring to FIG. 5, a link relief aperture 142 may be defined between the back plate 140 and the link insertion gap 124. Moreover, a second link relief aperture 144 may be defined between the back plate 140 and a portion of the static segment 112 disposed oppositely of the link insertion gap 124.

Referring to FIGS. 6 and 7, preferred embodiments of the jewelry spring clasp assembly 100 may further comprise an elongated jewelry chain element 146 extending from a first end link 148 to a second end link 150. The second end link 150 may be in slidable receipt of the static segment 112 and pass through the second link relief aperture 144. The elongated jewelry chain element 146 may have a length similar or identical to the lengths of typical jewelry chains conventionally used in necklaces or bracelets. Moreover, the elongated jewelry chain element 146 may be formed of a variety of metals and link configurations, such as those used in conventional necklaces and bracelets for example.

Referring to FIGS. 4 and 5, certain embodiments of the jewelry spring ring clasp assembly 100 may further comprise a door trigger 152 by which the door segment 114 is manually actuatable (e.g., by the user of the clasp assembly 100) to the open position. Referring to FIGS. 7, 19 and 25, in particular embodiments of the assembly 100, the door trigger 152 may preferably extend radially of the main axis 108 such that the visual obscurement does not apply to at least a radially outer portion 154 of the door trigger 152. In other words, the radially outer portion 154 of the door trigger 152 may remain clearly visible from the viewpoint 136 defined along the main axis 108 outward of the outboard face 120. In certain alternative embodiments of the assembly 100, the trigger 152 may be entirely visually obscured from the viewpoint 136, in addition to the ring element 102 and ring aperture 110.

Referring to FIG. 8, in preferred embodiments of the jewelry spring ring clasp assembly 100, the visual obscurement may apply to at least a circumferentially continuous portion (e.g., as shown at 156) of the ring element 102. The circumferentially continuous portion 156 may be defined, at least in part, by the portion of the ring element 102 disposed radially inward of a circumferential axis 178. The circumferential axis may extend along the ring element 102 at, for example, a preselected constant radius from the main axis 108. In the alternative, as shown for example in FIGS. 7, 19 and 25, the visual obscurement may apply to the entire ring element 102.

Figure 14:
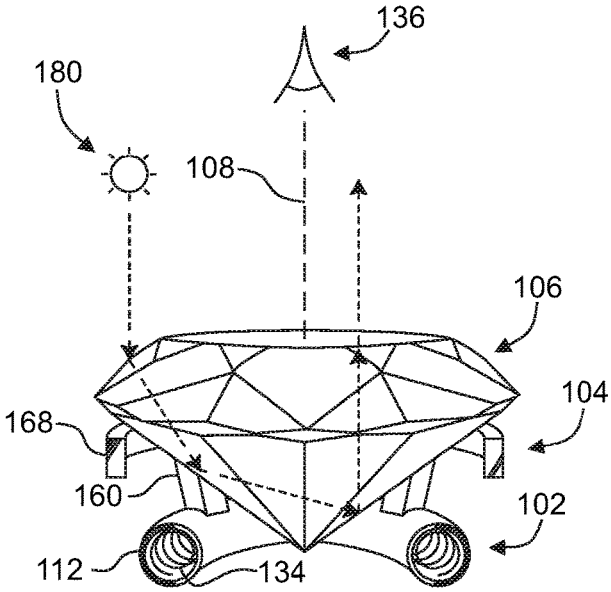
FIG. 14 is a diagrammatic partial cross-sectional view of the jewelry spring ring clasp assembly of FIG. 7, but illustrating visual obscurement of the ring aperture and the ring element at least in part due to optical refraction and/or reflection by and/or through the ornamental element.
Figure 15:
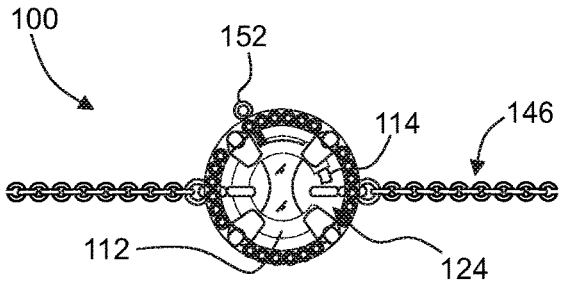
FIG. 15 is a diagrammatic front view of an alternative example of a jewelry spring ring clasp assembly, but wherein the ornamental element includes a halo configured to surround a center gemstone, the assembly is shown with the center gemstone removed, and the door segment is shown in an open position.
Figure 16:
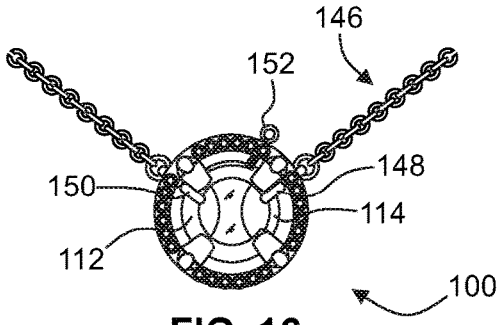
FIG. 16 is a diagrammatic front view of the jewelry spring ring clasp assembly of FIG. 15, but shown in a hanging configuration with a jewelry chain element, and with the door segment in its closed position.
Figure 17:
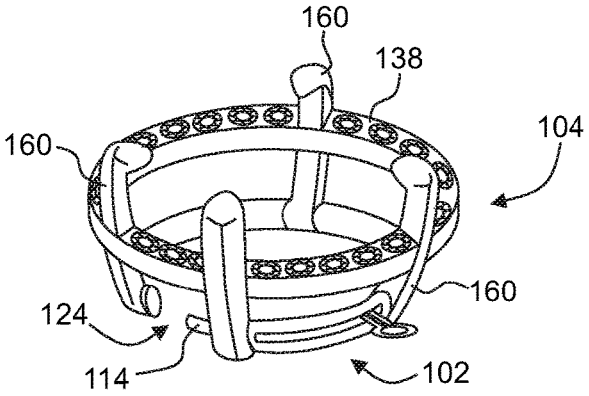
FIG. 17 is a diagrammatic perspective view of an example partially-assembled jewelry spring ring clasp assembly wherein the ornamental element includes a halo configured to surround a center gemstone, shown without the center gemstone and jewelry chain.
Figure 18:
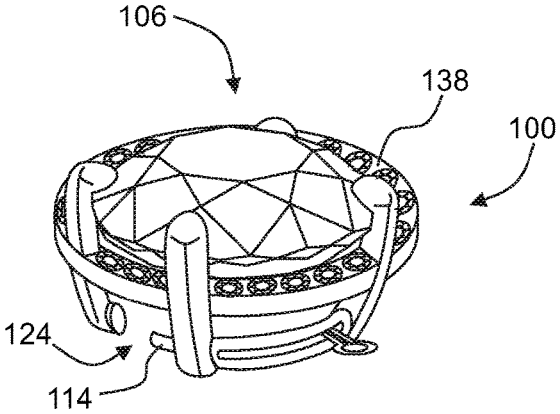
FIG. 18 is a diagrammatic perspective view similar to that of FIG. 17, but shown with a center gemstone mounted in the setting element.

Depending upon the particular embodiment of the jewelry spring clasp assembly 100 and the nature and configuration of its ornamental element 106, the visual obscurement may be due at least in part to optical refraction and/or reflection through the ornamental element. Referring to FIG. 14 for an example illustration, light from a light source 180 (such as the sun, fire or electrical lighting) may be refracted or reflected by portions of the ornamental element 106 so as to visually obscure (e.g., hide or distort) the ring element 102 from the viewpoint 136. Alternatively, or in addition, the visual obscurement may be due at least in part to optical opacity of the ornamental element 106. In one extreme example, this may be the case in an embodiment in which the ornamental element 106 largely comprised a black onyx.

Figure 12:
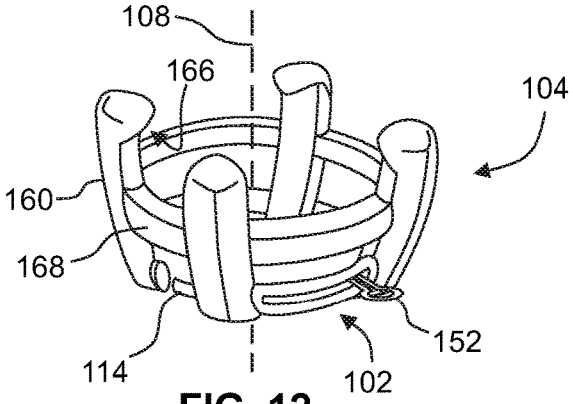
FIG. 12 is a diagrammatic perspective view of an example partially-assembled jewelry spring ring clasp assembly.
Figure 13:
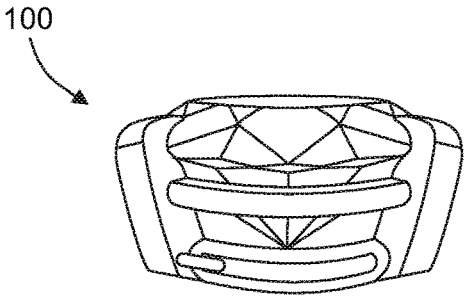
FIG. 13 is a diagrammatic perspective view of a jewelry spring ring clasp assembly similar to that of FIG. 1.

Referring to FIGS. 1, 2 and 12, in particular embodiments of the jewelry spring ring clasp assembly 100, the setting element 104 may preferably be made of a metal and include a multiplicity of prong members 160 distributed about the ring element 102. The prong members 160 may be affixed to the ring element 102 so as to extend outward of the outboard face 120. This may be done by, for example, soldering or otherwise adhering the prongs onto the static segment 112, or by integrally forming the static segment 112 and prong members 160 together by way of a unitary casting process. The setting element 104 may further include a medial support hoop 168 connected to each of the prong members 160, again by soldering or other conventional means. Referring to FIGS. 20-25, in particular embodiments of a jewelry spring clasp assembly 100, the setting element 104 may include one or more bezel segments 170. Each bezel segment 170 may include a bezel lip 172 by which the ornament element 106 is retained by the setting element 104.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A jewelry spring ring clasp assembly comprising:

(a) a ring element extending circumferentially about a main axis and thereby defining a ring aperture through the ring element, the ring element having a static segment and a door segment, the static segment having an inboard face and an outboard face disposed oppositely of one another along the main axis, the static segment being arcuately discontinuous so as to define a link insertion gap disposed radially of the main axis, the door segment being actuatable between a closed position and an open position, wherein (i) the link insertion gap is latchedly blocked when the door segment is in the closed position, (ii) the link insertion gap is traversable in a radial direction with respect to the main axis when the door segment is in the open position, and (iii) the door segment is spring-biased toward the closed position;

(b) a setting element which is (i) in fixed engagement with the static segment, and (ii) configured to retain an ornamental element in a fixed position along the main axis so that the ornamental element visually obscures the ring aperture and the ring element from a viewpoint defined along the main axis outward of the outboard face; and (c) a back plate extending diametrically across the ring aperture.

2. A jewelry spring ring clasp assembly as defined in claim 1 further comprising a said ornamental element retained in said fixed position, the ornamental element including a facetted center gemstone.

3. A jewelry spring ring clasp assembly as defined in claim 2 wherein the ornamental element includes a halo laterally surrounding the center gemstone.

4. A jewelry spring ring clasp assembly as defined in claim 1 wherein the back plate is affixed to the inboard face.

5. A jewelry spring ring clasp assembly as defined in claim 1 wherein a link relief aperture is defined between the back plate and the link insertion gap.

6. A jewelry spring ring clasp assembly as defined in claim 5 wherein a second link relief aperture is defined between the back plate and a portion of the static segment disposed oppositely of the link insertion gap.

7. A jewelry spring ring clasp assembly as defined in claim 6 further comprising an elongated jewelry chain element extending from a first end link to a second end link, the second end link being in slidable receipt of the static segment and passing through the second link relief aperture.

8. A jewelry spring ring clasp assembly as defined in claim 1 further comprising a door trigger by which the door segment is actuatable to the open position, the door trigger extending radially of the main axis, wherein the visual obscurement does not apply to at least a radially outer portion of the door trigger.

9. A jewelry spring ring clasp assembly as defined in claim 1 wherein the visual obscurement applies to at least a circumferentially continuous portion of the ring element.

10. A jewelry spring ring clasp assembly as defined in claim 1 wherein the visual obscurement applies to the entire static segment of the ring element.

11. A jewelry spring ring clasp assembly as defined in claim 1 wherein the setting element includes one or more bezel segments.

12. A jewelry spring ring clasp assembly as defined in claim 1 wherein the fixed engagement is by way of a solder joint.

13. A jewelry spring ring clasp assembly as defined in claim 1 wherein the static segment and the setting element are integral.

14. A jewelry spring ring clasp assembly as defined in claim 1 wherein the static segment comprises a hollow tube, at least a portion of the door segment being slidably received within the hollow tube.

15. A jewelry spring ring clasp assembly comprising:

(a) a ring element extending circumferentially about a main axis and thereby defining a ring aperture through the ring element, the ring element having a static segment and a door segment, the static segment having an inboard face and an outboard face disposed oppositely of one another along the main axis, the static segment being arcuately discontinuous so as to define a link insertion gap disposed radially of the main axis, the door segment being actuatable between a closed position and an open position, wherein (i) the link insertion gap is latchedly blocked when the door segment is in the closed position, (ii) the link insertion gap is traversable in a radial direction with respect to the main axis when the door segment is in the open position, and (iii) the door segment is spring-biased toward the closed position;

(b) an ornamental element;

(c) a setting element in fixed engagement with the static segment and retaining the ornamental element in a fixed position along the main axis whereby the ornamental element visually obscures the ring aperture and the ring element from a viewpoint defined along the main axis outward of the outboard face; and (d) a back plate extending diametrically across the ring aperture and wherein a link relief aperture is defined between the back plate and the link insertion gap.

16. A jewelry spring ring clasp assembly as defined in claim 15 wherein the ornamental element is a gemstone.

17. A jewelry spring ring clasp assembly as defined in claim 15 wherein the ornamental element has optical opacity.

18. A jewelry spring ring clasp assembly as defined in claim 15 wherein a second link relief aperture is defined between the back plate and a portion of the static segment disposed oppositely of the link insertion gap, and the jewelry spring ring clasp assembly comprises an elongated jewelry chain element extending from a first end link to a second end link, the second end link being in slidable receipt of the static segment and passing through the second link relief aperture.

19. A jewelry spring ring clasp assembly as defined in claim 15 wherein the visual obscurement applies to a circumferentially continuous portion of the ring element or the entire ring element.

20. A jewelry spring ring clasp assembly as defined in claim 19 further comprising a door trigger by which the door segment is actuatable to the open position, the door trigger extending radially of the main axis, wherein the visual obscurement does not apply to at least a radially outer portion of the door trigger.

21. A jewelry spring ring clasp assembly comprising:

(a) a ring element extending circumferentially about a main axis and thereby defining a ring aperture through the ring element, the ring element having a static segment and a door segment, the static segment having an inboard face and an outboard face disposed oppositely of one another along the main axis, the static segment being arcuately discontinuous so as to define a link insertion gap disposed radially of the main axis, the door segment being actuatable between a closed position and an open position, wherein (i) the link insertion gap is latchedly blocked when the door segment is in the closed position, (ii) the link insertion gap is traversable in a radial direction with respect to the main axis when the door segment is in the open position, and (iii) the door segment is spring-biased toward the closed position; and (b) a setting element which is (i) in fixed engagement with the static segment, and (ii) configured to retain an ornamental element in a fixed position along the main axis so that the ornamental element visually obscures the ring aperture and the ring element from a viewpoint defined along the main axis outward of the outboard face;

wherein the setting element includes a multiplicity of prong members distributed about the ring element and extending outward of the outboard face; and wherein the setting element includes a medial support hoop connected to each of the prong members.

22. A jewelry spring ring clasp assembly comprising:

(a) a ring element extending circumferentially about a main axis and thereby defining a ring aperture through the ring element, the ring element having a static segment and a door segment, the static segment having an inboard face and an outboard face disposed oppositely of one another along the main axis, the static segment being arcuately discontinuous so as to define a link insertion gap disposed radially of the main axis, the door segment being actuatable between a closed position and an open position, wherein (i) the link insertion gap is latchedly blocked when the door segment is in the closed position, (ii) the link insertion gap is traversable in a radial direction with respect to the main axis when the door segment is in the open position, and (iii) the door segment is spring-biased toward the closed position;

(b) an ornamental element; and (c) a setting element in fixed engagement with the static segment and retaining the ornamental element in a fixed position along the main axis whereby the ornamental element visually obscures the ring aperture and the ring element from a viewpoint defined along the main axis outward of the outboard face;

wherein the setting element includes a multiplicity of prong members distributed about the ring element and extending outward of the outboard face, and the ornamental element includes a center gemstone; and wherein the setting element includes a medial support hoop connected to each of the prong members.

* * * * *